US010648302B2

(12) United States Patent
Gonzalez

(10) Patent No.: US 10,648,302 B2
(45) Date of Patent: May 12, 2020

(54) ADJUSTABLE FLOW CONTROL DEVICE

(71) Applicant: Jose Rafael Gonzalez, Fulshear, TX (US)

(72) Inventor: Jose Rafael Gonzalez, Fulshear, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 218 days.

(21) Appl. No.: 15/813,439

(22) Filed: Nov. 15, 2017

(65) Prior Publication Data

US 2019/0145206 A1 May 16, 2019

(51) Int. Cl.
*E21B 43/12* (2006.01)
*E21B 34/08* (2006.01)

(52) U.S. Cl.
CPC ..... *E21B 43/12* (2013.01); *E21B 34/08* (2013.01)

(58) Field of Classification Search
CPC ..... E21B 21/103; E21B 43/12; E21B 21/08; E21B 34/08; E21B 43/00
See application file for complete search history.

(56) References Cited

U.S. PATENT DOCUMENTS

| | | | | |
|---|---|---|---|---|
| 8,820,413 | B2 * | 9/2014 | Mathiesen | E21B 34/08 166/373 |
| 8,875,797 | B2 | 11/2014 | Aakre et al. | |
| 9,038,649 | B2 | 5/2015 | Aakre et al. | |
| 9,556,706 | B1 * | 1/2017 | Zhao | E21B 34/08 |
| 2008/0035875 | A1 * | 2/2008 | Tai | F16K 99/0005 251/318 |
| 2012/0168164 | A1 * | 7/2012 | Sun | E21B 21/103 166/305.1 |
| 2013/0228341 | A1 * | 9/2013 | Fripp | E21B 43/12 166/373 |
| 2013/0277059 | A1 * | 10/2013 | Holderman | E21B 34/08 166/319 |

* cited by examiner

*Primary Examiner* — Michael R Wills, III
(74) *Attorney, Agent, or Firm* — Cantor Colburn LLP

(57) ABSTRACT

A flow control device includes a first tubular having an outer surface, and a second tubular arranged radially outwardly of the first tubular. The second tubular includes an inner surface portion and an outer surface portion. The inner surface portion is spaced from the outer surface of the first tubular by a gap. The second tubular includes a plurality of openings extending through the outer surface and the inner surface. A plate is moveably arranged in the gap adjacent to at least one of the plurality of openings. The plate includes a surface section spaced from the inner surface portion a selected distance.

13 Claims, 5 Drawing Sheets

ADJUSTABLE FLOW CONTROL DEVICE

BACKGROUND

In the resource recovery and exploration industry, flow control devices are utilized to control fluid flow into and out from a resource bearing formation. Often times, flow control devices are employed to establish a desired flow rate and/or pressure of a fluid passing from or into a formation. Typically, three types of fluid may pass into or out from a formation. Gases, low viscosity fluids such as water, and high viscosity fluids. Given the different viscosities of the fluids, controlling flow is a benefit.

In an inflow device, as an example, an influx of gas and or water may be at a velocity and pressure that could exclude more desirable higher viscosity fluids. For example, during a break through, steam may pass into a collector at a pressure that could exclude production fluids entering the collector at another location. Accordingly, the art would be appreciative of a device that would selectively adjust a pressure drop in an ICD in order to control inflow of selected fluids.

SUMMARY

Disclosed is a flow control device including a first tubular having an outer surface, and a second tubular arranged radially outwardly of the first tubular. The second tubular includes an inner surface portion and an outer surface portion. The inner surface portion is spaced from the outer surface of the first tubular by a gap. The second tubular includes a plurality of openings extending through the outer surface and the inner surface. A plate is moveably arranged in the gap adjacent to at least one of the plurality of openings. The plate includes a surface section spaced from the inner surface portion a selected distance.

Also disclosed is a resource recovery and exploration system including a first system; and a second system connected to the first system through a plurality of tubulars. At least one of the plurality of tubulars includes a flow control device including a first tubular having an outer surface, and a second tubular arranged radially outwardly of the first tubular. The second tubular includes an inner surface portion and an outer surface portion. The inner surface portion is spaced from the outer surface of the first tubular by a gap. The second tubular includes a plurality of openings extending through the outer surface and the inner surface. A plate is moveably arranged in the gap adjacent to at least one of the plurality of openings. The plate includes a surface section spaced from the inner surface portion a selected distance.

Further disclosed is a method of controlling a flow through an opening in a tubular including directing the flow through a gap between a first tubular and a second tubular, impacting a plate moveably mounted in the gap, vibrating the plate in the gap, and impeding the flow through an opening formed in one of the first tubular and the second tubular with the plate.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
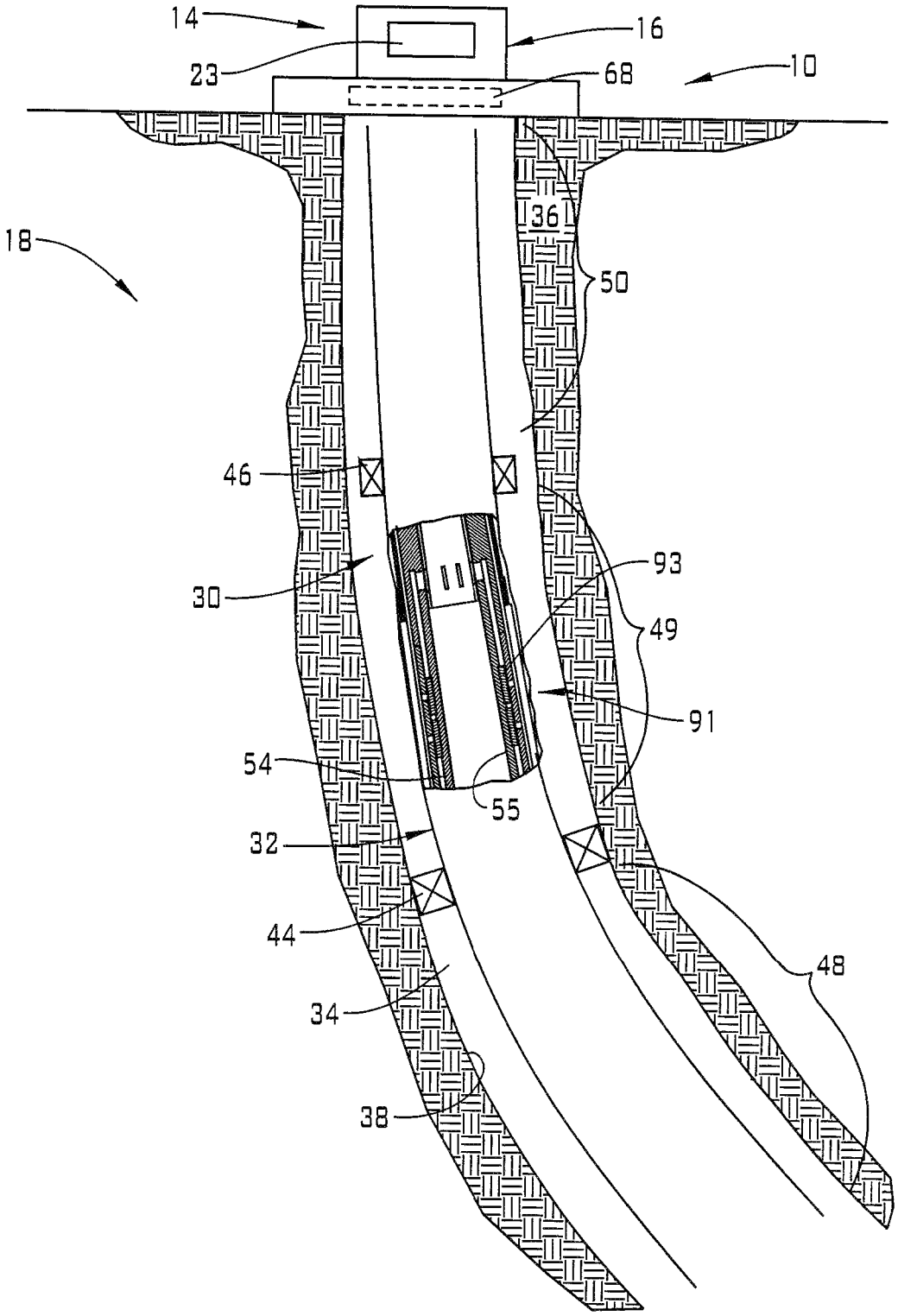
FIG. 1 depicts a resource recovery and exploration system including a flow control device, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations as will be discussed herein. Surface system 16 may include additional systems such as pumps, fluid storage systems, cranes and the like.

Second system 18 may include a tubular string 30 formed from a plurality of tubulars, one of which is indicated at 32 that is extended into a wellbore 34 formed in formation 36. Wellbore 34 includes an annular wall 38 which may be defined by a surface of formation 36, or a casing tubular (not shown). A first expandable member which may take the form of a first packer 44 is arranged on tubular 32. First packer 44 may be selectively expanded into contact with annular wall 38. A second expandable device which may take the form of a second packer 46 is arranged on tubular 32 spaced from first packer 44 along tubular string 30. First and second packers 44 and 46 may collectively define a first zone 48, a second zone 49 and a third zone 50 along tubular string 30. The number, size and location of each zone 48-50 may vary.

Figure 2:
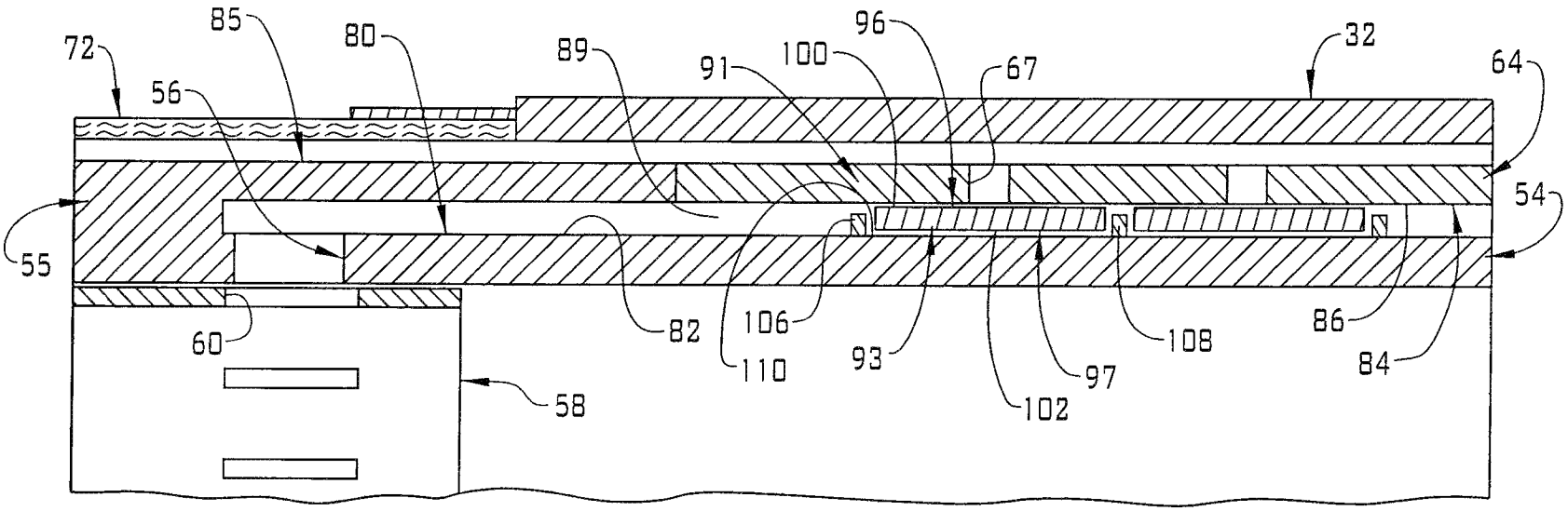
FIG. 2 depicts a partial cross-sectional view of a tubular having a flow control device, in accordance with an aspect of an exemplary embodiment.

In accordance with an aspect of an exemplary embodiment depicted in FIG. 2, a first inner tubular 54 is arranged radially inwardly of tubular 32. A second inner tubular 55 is arranged between first inner tubular 54 and tubular 32. First inner tubular 54 may include one or more passages 56. A sliding sleeve 58 may be arranged radially inwardly of first inner tubular 54. Sliding sleeve 58 may include one or more ports 60 that may be selectively aligned with one or more passages 56 to permit fluid flow into and out of first inner tubular 54.

Second inner tubular 55 may include a perforated plate 64. Perforated plate 64 may be an integral part of second inner tubular 55 or may be arranged longitudinally adjacent. Perforated plate 64 includes a plurality of openings, one of which is indicated at 67 that are selectively fluidically connected with passages 56. A screen assembly 72 is arranged radially outwardly of tubular 32. In the exemplary embodiment shown, screen assembly 72 is arranged on tubular 32 in second zone 49. Screen assembly 72 strains fluid that may be passing into or out from tubular 32.

Figure 3:
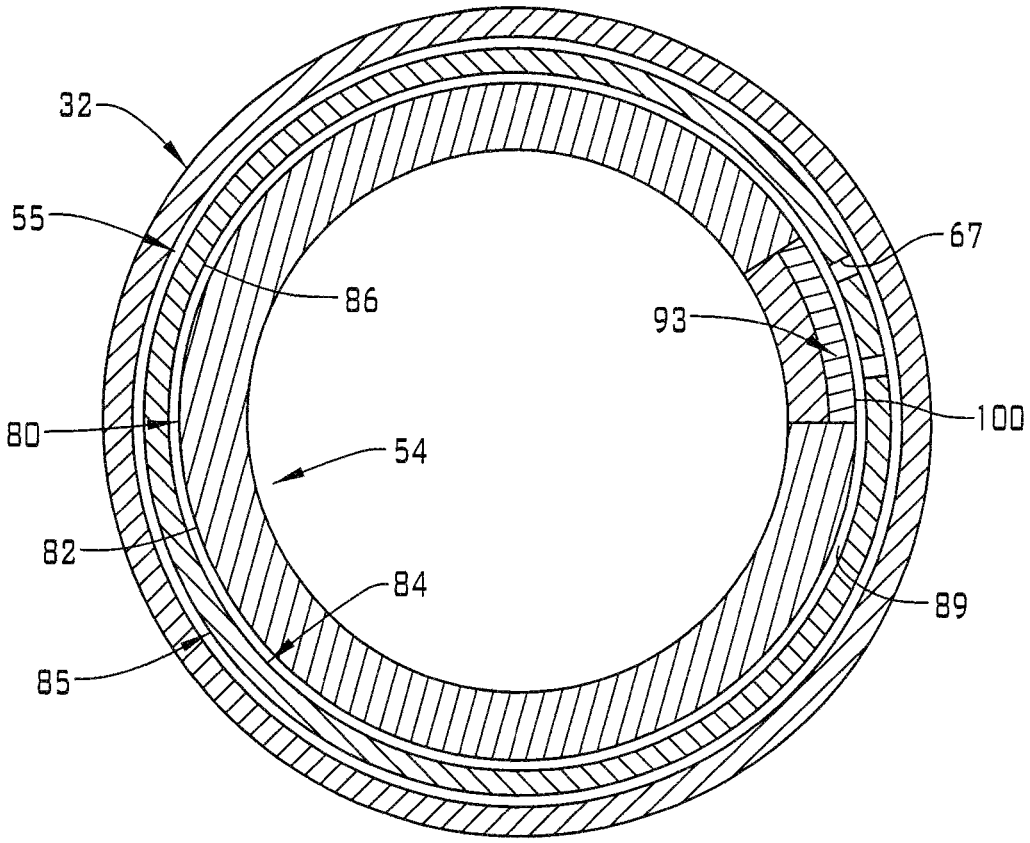
FIG. 3 depicts an axial end view of the tubular of FIG. 2.

As depicted in FIG. 3 and with continued reference to FIG. 2, first inner tubular 54 includes an outer surface 80 including an outer annular contour 82 and second inner tubular 55 includes an inner surface portion 84 and an inner surface portion 84. Inner surface portion 84 includes an inner annular contour portion 86. Outer surface 80 is spaced from outer surface portion 85 by a gap 89 having a selected dimension. The nature of the dimension may vary depending upon downhole fluids expected to flow into tubular 32 or fluids intended to be injected from tubular 32.

In accordance with an exemplary aspect, a flow control device 91 shown in the form of one or more plates, one of which is indicated at 93 is arranged within gap 89 at each of openings 67. Plate 93 includes an outer surface segment 96 and an inner surface segment 97. Outer surface segment 96 includes an outer contour 100 that closely matches inner annular contour 82 of inner surface portion 85. Inner surface segment 97 includes an inner surface contour 102 that closely matches outer annular contour 82 of outer surface 80. The term "closely match" should be understood to describe that outer contour 100 is substantially identical to inner annular contour 86 and inner surface contour 102 is substantially identical to outer annular contour 82. Plate 93 floats within gap 89. By "floats" it should be understood that plate 93 is free to move radially relative to, for example, first inner tubular 54 and second inner tubular 55. As such, when impacted by fluid passing into or out from opening 67, plate 93 vibrates. Vibration of plate 93 creates a vacuum affect. The vacuum affect draws plate 93 radially outwardly toward inner surface portion 84 across opening 67. In this manner, plate 93 will restrict fluid flow through opening 67. The particular degree of restriction is directly related to a viscosity of the fluid passing through opening 67, Thus, a distance between outer surface segment 96 of plate 93 and inner surface portion 84 of second inner tubular 55 may be selected based on an expected viscosity of fluid passing through tubular 32.

In accordance with an exemplary aspect depicted in FIG. 2, a first rib 106 projects radially outwardly from outer surface 80 of first inner tubular 54. A second rib 108 projects radially outwardly from outer surface 80 of first inner tubular 54 longitudinally spaced from first rib 106. A plate receiving recess 110 is defined between first and second ribs 106 and 108. Plate 93 is arranged in plate receiving recess 110. Fluid passing through opening 67 contacts outer surface segment 96, causing plate 93 to vibrate and be drawn towards inner surface portion 84 of perforated plate 64. Vibration frequency of plate 93 is dependent upon fluid viscosity and a distance between outer surface segment 96 and inner surface portion 84. As outer surface segment 96 is drawn towards inner surface portion 84 a pressure drop will occur impeding flow of fluid passing through opening 67.

Figure 4:
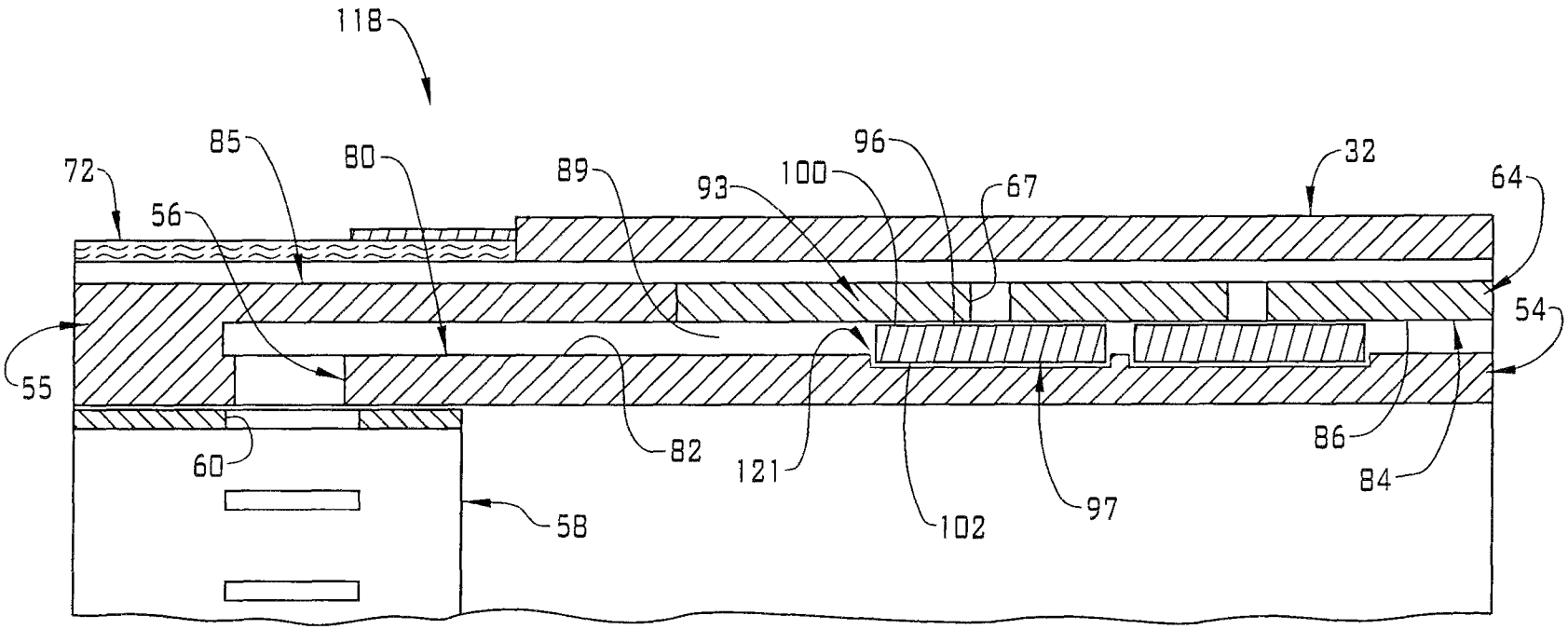
FIG. 4 depicts a partial cross-sectional view of a tubular having a flow control device, in accordance with another aspect of an exemplary embodiment.

Reference will now follow to FIG. 4, wherein like reference numbers represent corresponding parts in the respective views, in scribing a flow control device 118 in accordance with another aspect of an exemplary embodiment. In the exemplary aspect shown, plate 93 is floatingly arranged in a plate receiving recess 121 formed in outer surface 80 of first inner tubular 54. Of course, it should be understood that plate receiving recess 121 could also be formed in inner surface portion 84 of second inner tubular 55. In a manner similar to that described above, fluid passing through opening 67 contacts outer surface segment 96, causing plate 93 to vibrate and be drawn towards inner surface portion 84 of perforated plate 64. Vibration frequency of plate 93 is dependent upon fluid viscosity and a distance between outer surface segment 96 and inner surface portion 84. As outer surface segment 96 is drawn towards inner surface portion 84, a pressure drop will occur impeding the flow of fluid passing through opening 67.

Figure 5:
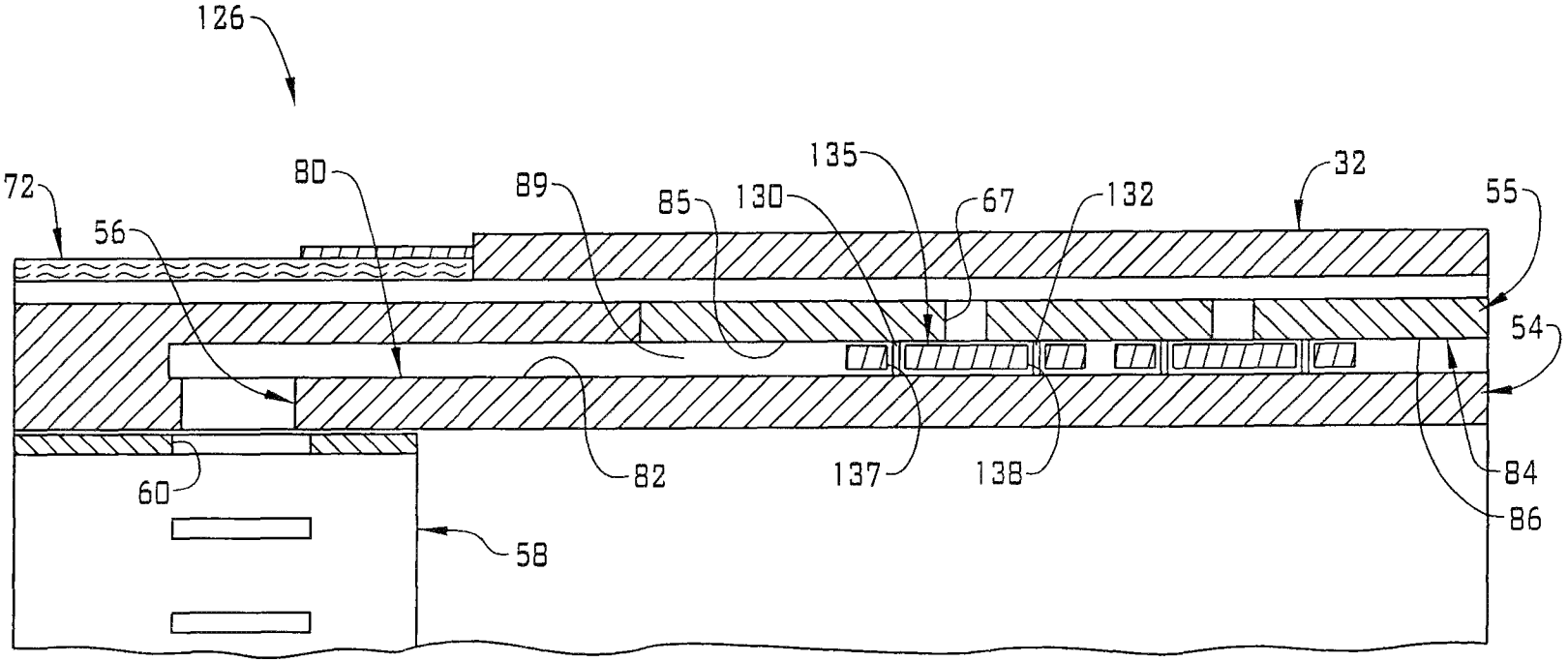
FIG. 5 depicts a partial cross-sectional view of a tubular having a flow control device, in accordance with yet another aspect of an exemplary embodiment.

Reference will now follow to FIG. 5, wherein like reference numbers represent corresponding parts in the respective views, in describing a flow control device 126 in accordance with another aspect of an exemplary embodiment. A first pin 130 extends between outer surface 80 of first inner tubular 54 and outer surface portion 85 of second inner tubular 55. A second pin 132 extends between outer surface 80 of first inner tubular 54 and inner surface portion 84 of second inner tubular 55 longitudinally spaced from first pin 130. First and second pins 130 and 132 may connect to one, the other, or both of first inner tubular 54 and second inner tubular 55. A plate 135 is slidingly and floatingly supported by first and second pins 130 and 132. Specifically, plate 135 includes a first passage 137 receptive of first pin 130 and a second passage 138 receptive of second pin 132. It should be understood that the number of pins retaining plate 135 may vary.

At this point, it should be understood that the exemplary embodiments describe a system for controlling flow through an office with flow control being dependent upon fluid viscosity. In this manner, less viscous fluid may excite the plate at a higher frequency causing a larger pressure drop while more viscous fluids may excite the plate at a lower frequency causing a lower pressure drop. Accordingly, less viscous fluids, such as steam, will be excluded at a rate that exceeds exclusion of more viscous fluids, such as production fluids. Thus, the flow control device of the exemplary embodiments provides real time choking of less desirable fluids without the need for sensors that detect fluid type and tools that may control flow control device restrictions. Further, in addition to directing fluids into the formation e.g., injection, the flow control device may be bi-directional and may also, or in the alternative, receive fluids from wellbore 34.

Set forth below are some embodiments of the foregoing disclosure:

Embodiment 1

A flow control device including a first tubular having an outer surface, and a second tubular arranged radially outwardly of the first tubular. The second tubular includes an inner surface portion and an outer surface portion. The inner surface portion is spaced from the outer surface of the first tubular by a gap. The second tubular includes a plurality of openings extending through the outer surface and the inner surface. A plate is moveably arranged in the gap adjacent to at least one of the plurality of openings. The plate includes a surface section spaced from the inner surface portion a selected distance.

Embodiment 2

The flow control device in any previous embodiment, wherein at least one of the outer surface and the inner surface portion includes a first rib projecting radially from a corresponding one of the first tubular and the second tubular and at least one of the outer surface and the inner surface portion includes a second rib projecting radially from a corresponding one of the first tubular and the second tubular, the second rib being spaced from the first rib forming a plate receiving recess, the plate being arranged between the first and second ribs in the plate receiving recess.

Embodiment 3

The flow control device in any previous embodiment, wherein the plate floats in the plate receiving recess relative to the first tubular and the second tubular.

Embodiment 4

The flow control device in any previous embodiment, wherein the first rib projects radially outwardly from the outer surface and the second rib projects radially outwardly from the outer surface.

Embodiment 5

The flow control device in any previous embodiment, wherein one of the first tubular and the second tubular includes a plate receiving recess formed in a corresponding one of the outer surface and the inner surface portion.

Embodiment 6

The flow control device in any previous embodiment, wherein the plate floats in the plate receiving recess relative to the one of the first tubular and the second tubular.

Embodiment 7

The flow control device in any previous embodiment, wherein the plate receiving recess is formed in the first tubular.

Embodiment 8

The flow control device in any previous embodiment, further comprising: a first pin radially extending from one of the outer surface and the inner surface portion and a second pin extending from one of the outer surface and the inner surface portion.

Embodiment 9

The flow control device in any previous embodiment, wherein at least one of the plurality of openings is arranged between the first and second pins.

Embodiment 10

The flow control device in any previous embodiment, wherein the plate includes a first passage receptive of the first pin and a second opening receptive of the second pin, the plate floating along the first and second pins relative to the first tubular and the second tubular.

Embodiment 11

A resource recovery and exploration system including a first system; and a second system connected to the first system through a plurality of tubulars. At least one of the plurality of tubulars includes a flow control device including a first tubular having an outer surface, and a second tubular arranged radially outwardly of the first tubular. The second tubular includes an inner surface portion and an outer surface portion. The inner surface portion is spaced from the outer surface of the first tubular by a gap. The second tubular includes a plurality of openings extending through the outer surface and the inner surface. A plate is moveably arranged in the gap adjacent to at least one of the plurality of openings. The plate includes a surface section spaced from the inner surface portion a selected distance.

Embodiment 12

The resource recovery and exploration system in any previous embodiment, wherein at least one of the outer surface and the inner surface portion includes a first rib projecting radially from a corresponding one of the first tubular and the second tubular and at least one of the outer surface and the inner surface portion includes a second rib projecting radially from a corresponding one of the first tubular and the second tubular, the second rib being spaced from the first rib forming a plate receiving recess, the plate being arranged between the first and second ribs in the plate receiving recess, the plate floating in the plate receiving recess relative to the first tubular and the second tubular.

Embodiment 13

The resource recovery and exploration system in any previous embodiment, wherein one of the first tubular and the second tubular includes a plate receiving recess formed in a corresponding one of the outer surface and the inner surface portion, the plate floating in the plate receiving recess relative to the first tubular and the second tubular.

Embodiment 14

The resource recovery and exploration system in any previous embodiment, further comprising: a first pin radially extending from one of the outer surface and the inner surface portion and a second pin extending from one of the outer surface and the inner surface portion, wherein the plate includes a first passage receptive of the first pin and a second opening receptive of the second pin, the plate floating along the first and second pins relative to the first tubular and the second tubular.

Embodiment 15

A method of controlling a flow through an opening in a tubular including directing the flow through a gap between a first tubular and a second tubular, impacting a plate moveably mounted in the gap, vibrating the plate in the gap, and impeding the flow through an opening formed in one of the first tubular and the second tubular with the plate.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A flow control device comprising:

a first tubular having an outer surface;

a second tubular arranged radially outwardly of the first tubular, the second tubular including an inner surface portion and an outer surface portion, the inner surface portion being spaced from the outer surface of the first tubular by a gap, the second tubular including a plurality of openings extending through the outer surface and the inner surface; and a plate moveably arranged in the gap adjacent to at least one of the plurality of openings, the plate including a surface section spaced from the inner surface portion a selected distance such that the plate floats in the gap relative to the first tubular and the second tubular.

2. The flow control device according to claim 1, wherein at least one of the outer surface and the inner surface portion includes a first rib projecting radially from a corresponding one of the first tubular and the second tubular and at least one of the outer surface and the inner surface portion includes a second rib projecting radially from a corresponding one of the first tubular and the second tubular, the second rib being spaced from the first rib forming a plate receiving recess, the plate being arranged between the first and second ribs in the plate receiving recess.

3. The flow control device according to claim 2, wherein the first rib projects radially outwardly from the outer surface and the second rib projects radially outwardly from the outer surface.

4. The flow control device according to claim 1, wherein one of the first tubular and the second tubular includes a plate receiving recess formed in a corresponding one of the outer surface and the inner surface portion.

5. The flow control device according to claim 4, wherein the plate floats in the plate receiving recess relative to the one of the first tubular and the second tubular.

6. The flow control device according to claim 4, wherein the plate receiving recess is formed in the first tubular.

7. The flow control device according to claim 1, further comprising: a first pin radially extending from one of the outer surface and the inner surface portion and a second pin extending from one of the outer surface and the inner surface portion.

8. The flow control device according to claim 7, wherein at least one of the plurality of openings is arranged between the first and second pins.

9. The flow control device according to claim 7, wherein the plate includes a first passage receptive of the first pin and a second opening receptive of the second pin, the plate floating along the first and second pins relative to the first tubular and the second tubular.

10. A resource recovery and exploration system comprising: a surface system; and a subsurface system connected to the surface system through a plurality of tubulars, at least one of the plurality of tubulars including a flow control device comprising: a first tubular having an outer surface; a second tubular arranged radially outwardly of the first tubular, the second tubular including an inner surface portion and an outer surface portion, the inner surface portion being spaced from the outer surface of the first tubular by a gap, the second tubular including a plurality of openings extending through the outer surface and the inner surface; and a plate moveably arranged in the gap adjacent to at least one of the plurality of openings, the plate including a surface section spaced from the inner surface portion a selected distance such that the plate floats in the gap relative to the first tubular and the second tubular.

11. The resource recovery and exploration system according to claim 10, wherein at least one of the outer surface and the inner surface portion includes a first rib projecting radially from a corresponding one of the first tubular and the second tubular and at least one of the outer surface and the inner surface portion includes a second rib projecting radially from a corresponding one of the first tubular and the second tubular, the second rib being spaced from the first rib forming a plate receiving recess, the plate being arranged between the first and second ribs in the plate receiving recess, the plate floating in the plate receiving recess relative to the first tubular and the second tubular.

12. The resource recovery and exploration system according to claim 10, further comprising: a first pin radially extending from one of the outer surface and the inner surface portion and a second pin extending from one of the outer surface and the inner surface portion, wherein the plate includes a first passage receptive of the first pin and a second opening receptive of the second pin, the plate floating along the first and second pins relative to the first tubular and the second tubular.

13. A method of controlling a flow through an opening in a tubular comprising:

directing the flow through a gap between a first tubular and a second tubular;

impacting a plate floating in the gap;

vibrating the plate in the gap; and impeding the flow through an opening formed in one of the first tubular and the second tubular with the plate.

* * * * *